US009695002B2

(12) United States Patent
Takenaka

(10) Patent No.: US 9,695,002 B2
(45) Date of Patent: Jul. 4, 2017

(54) SHEET FEEDER CONTROL METHOD, SHEET FEEDER, AND IMAGE FORMING APPARATUS

(71) Applicant: Ryo Takenaka, Tokyo (JP)

(72) Inventor: Ryo Takenaka, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 22 days.

(21) Appl. No.: 14/597,640

(22) Filed: Jan. 15, 2015

(65) Prior Publication Data

US 2015/0125165 A1 May 7, 2015

Related U.S. Application Data

(63) Continuation of application No. 14/095,185, filed on Dec. 3, 2013, now Pat. No. 8,960,672.

(30) Foreign Application Priority Data

Dec. 27, 2012 (JP) ..... 2012-284611

(51) Int. Cl.
*B65H 7/02* (2006.01)
*B65H 7/06* (2006.01)
(Continued)

(52) U.S. Cl.
CPC ..... *B65H 7/06* (2013.01); *B65H 5/06* (2013.01); *B65H 5/26* (2013.01); *B65H 7/04* (2013.01);
(Continued)

(58) Field of Classification Search
CPC . B65H 5/062; B65H 7/02; B65H 7/04; B65H 7/06; B65H 7/14; B65H 7/20;
(Continued)

(56) References Cited

U.S. PATENT DOCUMENTS 5,034,780 A 7/1991 Kotabe et al.
5,365,322 A 11/1994 Hamada et al.
(Continued)

FOREIGN PATENT DOCUMENTS

JP H 02-93660 A 4/1990
JP 2000-085220 A 3/2000
(Continued)

OTHER PUBLICATIONS

Office Action dated Sep. 29, 2016 for Japanese Patent Application 2012-2846111.

*Primary Examiner* — Prasad Gokhale
(74) *Attorney, Agent, or Firm* — Harness, Dickey & Pierce, P.L.C.

(57) ABSTRACT

A sheet feeder control method for controlling a sheet feeder of an image forming apparatus includes feeding a sheet through a sheet feed path exposable to the exterior of the sheet feeder, detecting the feeding of the sheet at at least a first position on the sheet feed path, discharging the fed sheet to the exterior of the sheet feeder, detecting the discharge of the sheet at a second position downstream of the first position in a sheet feeding direction, detecting a sheet jam during the feeding and discharging of the sheet, and if the jammed sheet is detected at the second position but not at the first position, cancelling a malfunction state due to the sheet jam when the sheet stops being detected at the second position, irrespective of whether the sheet feed path is covered or exposed.

14 Claims, 5 Drawing Sheets

(51) Int. Cl.

| | |
|---|---|
| ***B65H 7/04*** | (2006.01) |
| ***B65H 31/10*** | (2006.01) |
| ***B65H 31/24*** | (2006.01) |
| ***B65H 43/02*** | (2006.01) |
| ***B65H 85/00*** | (2006.01) |
| ***G03G 15/00*** | (2006.01) |
| ***G03G 21/16*** | (2006.01) |
| ***B65H 5/06*** | (2006.01) |
| ***B65H 5/26*** | (2006.01) |
| ***B65H 15/00*** | (2006.01) |
| ***B65H 29/22*** | (2006.01) |
| ***B65H 43/04*** | (2006.01) |
| *G03G 15/23* | (2006.01) |

(52) U.S. Cl.

CPC ..... *B65H 15/00* (2013.01); *B65H 29/22* (2013.01); *B65H 31/10* (2013.01); *B65H 31/24* (2013.01); *B65H 43/02* (2013.01); *B65H 43/04* (2013.01); *B65H 85/00* (2013.01); *G03G 15/5012* (2013.01); *G03G 15/70* (2013.01); *G03G 21/1633* (2013.01); *B65H 2402/441* (2013.01); *B65H 2405/332* (2013.01); *B65H 2511/51* (2013.01); *B65H 2511/515* (2013.01); *B65H 2511/528* (2013.01); *B65H 2513/53* (2013.01); *B65H 2601/11* (2013.01); *B65H 2601/255* (2013.01); *B65H 2801/06* (2013.01); *G03G 15/234* (2013.01); *G03G 2215/00544* (2013.01); *G03G 2215/00548* (2013.01); *G03G 2215/00586* (2013.01)

(58) Field of Classification Search

CPC ..... B65H 29/00; B65H 83/00; B65H 83/02; B65H 83/025; B65H 85/00; B65H 2553/00; B65H 2511/528; B65H 2601/11; B65H 2601/111; B65H 2601/255; B65H 43/02; B65H 43/04; G03G 15/5012; G03G 15/70; G03G 2215/00548; G03G 2215/00586

See application file for complete search history.

(56) References Cited

U.S. PATENT DOCUMENTS

| | | | | |
|---|---|---|---|---|
| 5,580,046 | A * | 12/1996 | Beaufort et al. | B65H 7/00 271/10.02 |
| 5,731,885 | A | 3/1998 | Nagahara | |
| 7,302,222 | B2 | 11/2007 | Ho et al. | |
| 2006/0233558 | A1 | 10/2006 | Son | |
| 2009/0080910 | A1 | 3/2009 | Kim et al. | |
| 2009/0102118 | A1* | 4/2009 | Shibano | B65H 7/06 271/265.03 |
| 2009/0148210 | A1* | 6/2009 | Takenaka | G03G 15/234 399/381 |
| 2009/0237440 | A1 | 9/2009 | Enomoto | |
| 2010/0019444 | A1 | 1/2010 | Kitazawa | |
| 2010/0187746 | A1 | 7/2010 | Hirata et al. | |
| 2012/0093525 | A1* | 4/2012 | Ota | B41J 11/006 399/21 |
| 2012/0286466 | A1* | 11/2012 | Arakane | B65H 3/0684 271/18 |
| 2013/0108284 | A1* | 5/2013 | Takata | G03G 15/6529 399/21 |
| 2014/0042692 | A1* | 2/2014 | Matsumoto | B65H 7/02 271/265.03 |

FOREIGN PATENT DOCUMENTS

| | | | |
|---|---|---|---|
| JP | 2005-225672 | A | 8/2005 |
| JP | 2006-126519 | A | 5/2006 |
| JP | 2007-230001 | A | 9/2007 |
| JP | 2009-256099 | A | 11/2009 |

* cited by examiner

SHEET FEEDER CONTROL METHOD, SHEET FEEDER, AND IMAGE FORMING APPARATUS

CROSS-REFERENCE TO RELATED APPLICATION

This application is a continuation of and claims priority under 35 U.S.C. §120/121 to U.S. application Ser. No. 14/095,185 filed Dec. 3, 2013, which is based on and claims priority pursuant to 35 U.S.C. §119 to Japanese Patent Application No. 2012-284611, filed on Dec. 27, 2012, in the Japan Patent Office, the contents of each of which are hereby incorporated herein by reference in their entirety and for all purposes.

BACKGROUND

Technical Field

Example embodiments relate to a sheet feeder control method for controlling a sheet feeder of an image forming apparatus, a sheet feeder for an image forming apparatus controlled by the sheet feeder control method, and an image forming apparatus equipped with the sheet feeder.

Related Art

In a sheet feeder of an image forming apparatus, it is common to detect the sheet feeding state by using a sheet sensor and detect a sheet jam (referred to as the jam in the present specification) on the basis of the detection result provided by the sheet sensor, such as the sheet sensor detecting no sheet within a predetermined time or continuing to detect a sheet for longer than a predetermined time.

In a typical sheet feeder, to detect the removal of the sheet remaining in the sheet feeder and return the sheet feeder to the normal state (i.e., usable state) from the jammed state, a cover of the sheet feeder for allowing the removal of the remaining sheet is first opened and then closed.

That is, whether or not a sheet remains in the sheet feeder is checked upon transition of the signal from an opening sensor that detects the opening and closing of the cover from a signal indicating the cover open state to a signal indicating the cover closed state. Then, if it is confirmed that any sheet remaining in the sheet feeder has been removed, the sheet feeder returns to the normal state from the jammed state.

However, according to this procedure, even if a sheet is stopped with most of the sheet discharged to the exterior of the sheet feeder and thus it is possible to complete an unjamming operation simply by pulling it, nevertheless an operation of opening and closing the cover is performed at least once. Such an operation is troublesome for users.

To further facilitate the unjamming operation, a mechanism may be provided that displays an instruction guide for the unjamming operation on an operation panel in accordance with detection results provided by a feed sensor and a cover opening and closing sensor, for example. Although generally successful for its intended purpose insofar as such a mechanism that presents a user with clear instructions for the unjamming operation, the mechanism does not address the issue that the process of returning the sheet feeder to the normal state involves the basically unnecessary operation of opening and closing the cover.

SUMMARY

Example embodiments provide an improved sheet feeder control method for controlling a sheet feeder of an image forming apparatus that, in one example, includes feeding a sheet through a sheet feed path exposable to the exterior of the sheet feeder, detecting the feeding of the sheet at at least a first position on the sheet feed path, discharging the fed sheet to the exterior of the sheet feeder, detecting the discharge of the sheet at a second position downstream of the first position in a sheet feeding direction, detecting a sheet jam during the feeding and discharging of the sheet, and if the jammed sheet is detected at the second position but not at the first position, cancelling a malfunction state due to the sheet jam when the sheet stops being detected at the second position, irrespective of whether the sheet feed path is covered or exposed.

Example embodiments further provide an improved sheet feeder that, in one example, includes a sheet feed path, at least one sheet sensor, a discharge roller pair, a discharge sensor, and a malfunction detector. The sheet feed path is exposable to the exterior of the sheet feeder. The at least one sheet sensor is located on the sheet feed path. The discharge roller pair is located downstream of the sheet feed path in a sheet feeding direction, and is configured to discharge the fed sheet to the exterior of the sheet feeder. The discharge sensor is located downstream of the sheet sensor in the sheet feeding direction, and is configured to detect the discharge of the sheet. The malfunction detector is configured to detect a sheet jam during the feeding and discharging of the sheet, and if the jammed sheet is detected by the discharge sensor but not by the sheet sensor, cancel a malfunction state due to the sheet jam when a signal output from the discharge sensor shifts from a signal indicating detection of the sheet to a signal indicating non-detection of the sheet, irrespective of whether the sheet feed path is covered or exposed.

Example embodiments further provide an improved image forming apparatus that, in one example, includes the above-described sheet feeder.

BRIEF DESCRIPTION OF THE DRAWINGS

A more complete appreciation of the invention and many of the advantages thereof are obtained as the same becomes better understood by reference to the following detailed description when considered in connection with the accompanying drawings, wherein.

DETAILED DESCRIPTION

Figure 1:
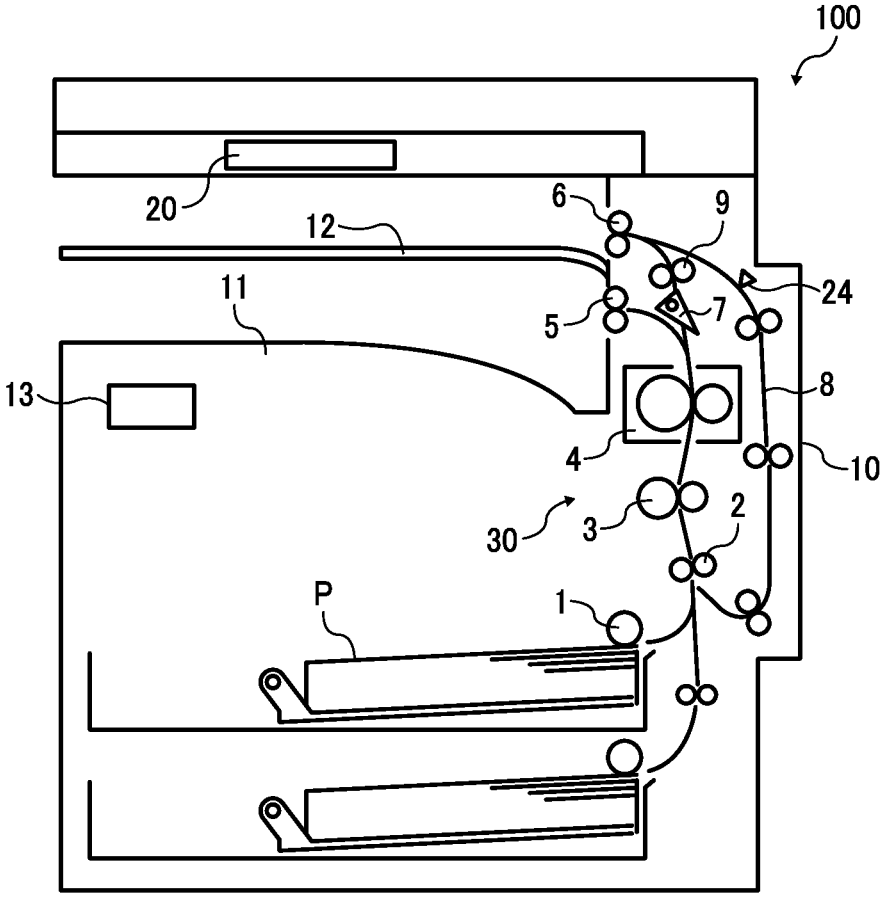
FIG. 1 is a diagram illustrating a configuration example of an image forming apparatus according to an embodiment example.

In describing the embodiments illustrated in the drawings, specific terminology is adopted for the purpose of clarity. However, the disclosure of the present invention is not intended to be limited to the specific terminology so used, and it is to be understood that substitutions for each specific element can include any technical equivalents that have the same function, operate in a similar manner, and achieve a similar result.

Referring now to the drawings, wherein like reference numerals designate identical or corresponding parts throughout the several views, an embodiment of the present invention will be described.

According to example embodiments, in a discharge section of a sheet feeder, if a sheet is detected by a discharge sensor that detects sheet discharge but not by a sheet sensor located upstream of the discharge sensor in a sheet feeding direction, the jammed state is cancelled when the signal from the discharge sensor shifts from a signal indicating the sheet presence to a signal indicating the sheet absence, irrespective of the detection result provided by a cover opening and closing sensor. That is, if the discharge sensor is ON and the sheet sensor is OFF, the sheet feeder returns to the normal mode upon turn-off of the discharge sensor as a trigger, not on the basis of the detection of the opening and closing of the cover.

Example embodiments also relate to an image forming apparatus, such as a copier, a printer, a facsimile machine, or a multifunction machine combining the functions of these apparatuses. An image forming apparatus according to an embodiment of the present invention, however, is not limited to the image forming apparatus according to the illustrated embodiment.

FIG. 1 illustrates a configuration example of an image forming apparatus according to an embodiment of the present invention. An image forming apparatus 100 illustrated in FIG. 1 is a so-called in-body sheet discharge-type image forming apparatus, in which a sheet discharge tray is provided in an open space in the body of the image forming apparatus. In the image forming apparatus 100, a sheet (i.e., recording medium) P is picked up by a sheet feed roller 1 to be separated from the other sheets P and subjected to skew correction by a registration roller pair 2. Then, a toner image is transferred onto the sheet P by a transfer roller 3 and fixed thereon by a fixing device 4. Specifically, in the fixing device 4, the toner image is fixed on the sheet P by heat and pressure applied thereto by, for example, a pressure roller and a heating roller at a fixing nip formed by the pressure roller and a heating roller. The sheet P is then discharged to the exterior of the image forming apparatus 100 by a sheet discharge roller pair 5.

The illustrated image forming apparatus 100 is configured to be capable of duplex printing. In duplex printing, the sheet P having the toner image fixed on one surface thereof is guided by a branching member 7 that bifurcates a feed path, and is fed to a reversing relay roller pair 9 and a reversing roller pair 6 (i.e., a reversing device). The reversing roller pair 6 discharges the sheet P halfway to a reverse tray 12, and then is reversely rotated to feed the downstream side in the sheet feeding direction of the sheet P (i.e., the trailing end of the sheet P) to a duplex feed path 8 (i.e., a switchback reversing operation). Thereby, the sheet P is again fed to the registration roller pair 2, and a toner image is formed on the other surface of the sheet P, i.e., the sheet P is subjected to duplex printing.

Figure 2:
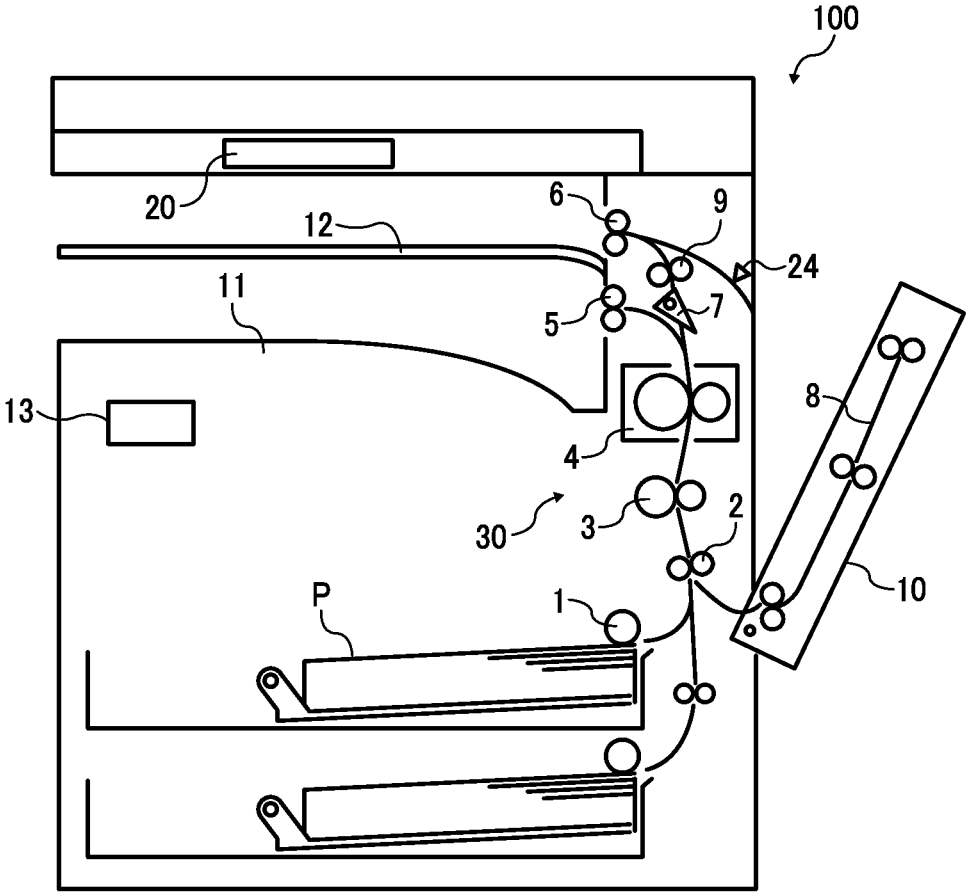
FIG. 2 is a diagram illustrating an open state of a cover of the image forming apparatus in FIG. 1 for covering a duplex feed path.

The image forming apparatus 100 further includes a display unit 20 and a cover 10. The display unit 20 includes a liquid crystal display (LCD) panel, for example, and serves as a presentation device that presents a variety of information to an operator, such as a user or a service engineer, for example. The cover 10 covering the duplex feed path 8 is configured to be openably closable to allow the removal of the sheet P in the event of a jam due to, for example, the slippage of a roller feeding the sheet P on the sheet feed path. That is, with the cover 10 opened in the state illustrated in FIG. 2, the image forming apparatus 100 is configured to allow the removal of the sheet P remaining therein. The image forming apparatus 100 further includes an opening and closing sensor 24 (i.e., opening and closing detector) that detects the opening and closing of the cover 10, and a controller 13.

In the image forming apparatus 100, a sheet feeder 30 is comprised of a sheet feed path extending from the sheet feed roller 1 to the sheet discharge roller pair 5, various rollers for feeding and discharging the sheet P including the sheet discharge roller pair 5, the controller 13, and later-described various sensors.

Figure 3:
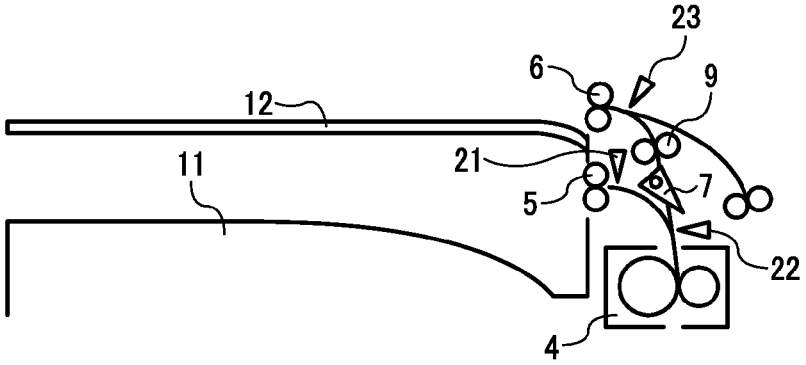
FIG. 3 is a diagram illustrating the configuration of a discharge section of the image forming apparatus.

FIG. 3 illustrates the configuration of the discharge section which discharges the sheet P to the exterior of the image forming apparatus 100. The discharge section includes, for example, the sheet discharge roller pair 5, a discharge tray 11, and a discharge sensor 21. FIG. 3 also illustrates a fixing exit sheet sensor 22 and a reversed sheet sensor 23 included in the sheet feeder 30.

Figure 4:
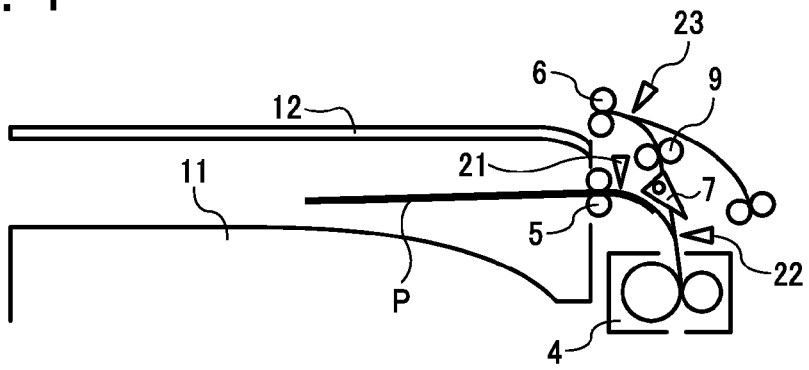
FIG. 4 is a diagram illustrating a state in which a sheet feeding operation is stopped owing to a jam occurring in the discharge section of the image forming apparatus.

In simplex printing in which the sheet P is discharged to the exterior of the image forming apparatus 100 after having a toner image formed on only one surface thereof, the sheet P exiting the fixing device 4 is detected by the fixing exit sheet sensor 22, passed through the discharge sensor 21, and discharged onto the discharge tray 11 by the sheet discharge roller pair 5. If the trailing end of the fed sheet P does not pass through the discharge sensor 21 within a predetermined time after the passage thereof through the fixing exit sheet sensor 22, the controller 13 determines that a jam has occurred in the image forming apparatus 100, and stops feeding the sheet P, as illustrated in FIG. 4. That is, the controller 13 functions as a malfunction detector. The controller 13 is, for example, a microcomputer including a central processing unit (CPU), a random access memory (RAM), a read only memory (ROM), and so forth.

In this state, it is understood from the detection result provided by the fixing exit sheet sensor 22 that the sheet P being discharged is clamped by the sheet discharge roller pair 5 but not by the fixing device 4 located upstream of the sheet discharge roller pair 5 in the sheet feeding direction. It is therefore possible to pull the sheet P out of the image forming apparatus 100 from the side of the discharge tray 11 with relatively weak force of approximately 6 Newtons (N), for example. That is, in this case, there is no need to open the cover 10 to fix the jam.

The display unit 20 including an LCD panel, for example, preferably presents (i.e., displays) information notifying the operator (e.g., user or service engineer) that it is possible to pull the sheet P out of the image forming apparatus 100. With instructions for sheet removal presented to the operator, instructions for a jammed sheet handling operation are clarified, thereby assisting the operator by providing a simpler sheet handling operation. Further, after the removal of the jammed sheet P, the display unit 20 preferably displays a message asking whether or not to print the same image as the image for the removed sheet P on the next sheet P. In this case, the jammed sheet P has passed through the fixing device 4, i.e., a print job on the sheet P has been completed. Therefore, the image forming apparatus 100 is configured not to unconditionally print the same image again after each jam but to first check with the operator as to the need to print the same image again. With this configuration, unnecessary printing is avoided.

The signal from the discharge sensor 21 continues to be checked at intervals of 0.5 seconds, for example, even after the occurrence of a jam. Upon removal of the jammed sheet P from the discharge sensor 21, the signal from the discharge sensor 21 shifts from the signal indicating the sheet presence to the signal indicating the sheet absence. Thereby, the controller 13 determines that the unjamming operation has been completed, and returns the image forming apparatus 100 to the normal state (i.e., printable state) from the jammed state (i.e., stopped state). In the process of returning the image forming apparatus 100 to the normal state from the jammed state, the controller 13 determines whether or not to cancel the jammed state on the basis of the information received from the discharge sensor 21, without taking into account the information as to the open or closed state of the cover 10 for covering the duplex feed path 8

Figure 5:
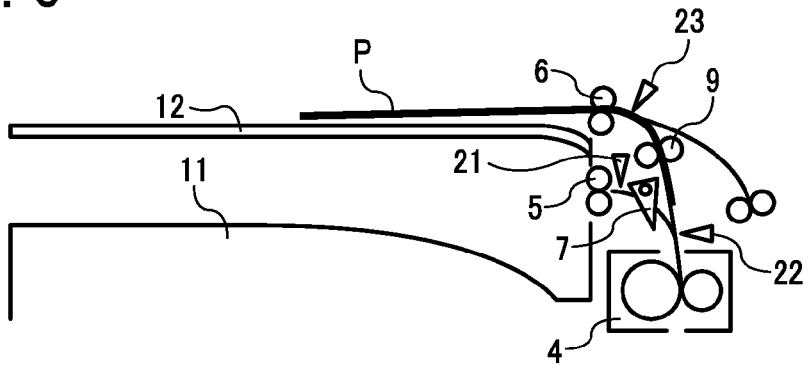
FIG. 5 is a diagram illustrating a state in which the sheet feeding operation is stopped owing to a jam occurring in a reversing roller pair of the image forming apparatus.

Similar control is applicable to the case in which the sheet P is fed to the reversing roller pair 6. Specifically, if the trailing end of the fed sheet P does not pass through the reversed sheet sensor 23 within a predetermined time after the passage thereof through the fixing exit sheet sensor 22, the controller 13 determines that a jam has occurred in the image forming apparatus 100, and stops feeding the sheet P, as illustrated in FIG. 5.

In this state, it is understood from the detection result provided by the fixing exit sheet sensor 22 that the sheet P being reversed is clamped by the reversing roller pair 6 and the reversing relay roller pair 9 but not by the fixing device 4 located upstream of the reversing roller pair 6 and the reversing relay roller pair 9 in the sheet feeding direction. It is therefore possible to pull the sheet P out of the image forming apparatus 100 from the side of the reverse tray 12 with force of approximately 16 N, for example.

The signal from the reversed sheet sensor 23 continues to be checked at intervals of 0.5 seconds, for example, even after the occurrence of a jam. Upon removal of the jammed sheet P from the reversed sheet sensor 23, the signal from the reversed sheet sensor 23 shifts from the signal indicating the sheet presence to the signal indicating the sheet absence. Thereby, the controller 13 determines that the unjamming operation has been completed, and returns the image forming apparatus 100 to the normal state (i.e., printable state) from the jammed state (i.e., stopped state). In the process of returning the image forming apparatus 100 to the normal state from the jammed state, the controller 13 determines whether or not to cancel the jammed state on the basis of the information received from the reversed sheet sensor 23, without taking into account the information as to the open or closed state of the cover 10 for covering the duplex feed path 8. Also in this case, the display unit 20 preferably presents the above-described information.

Figure 6:
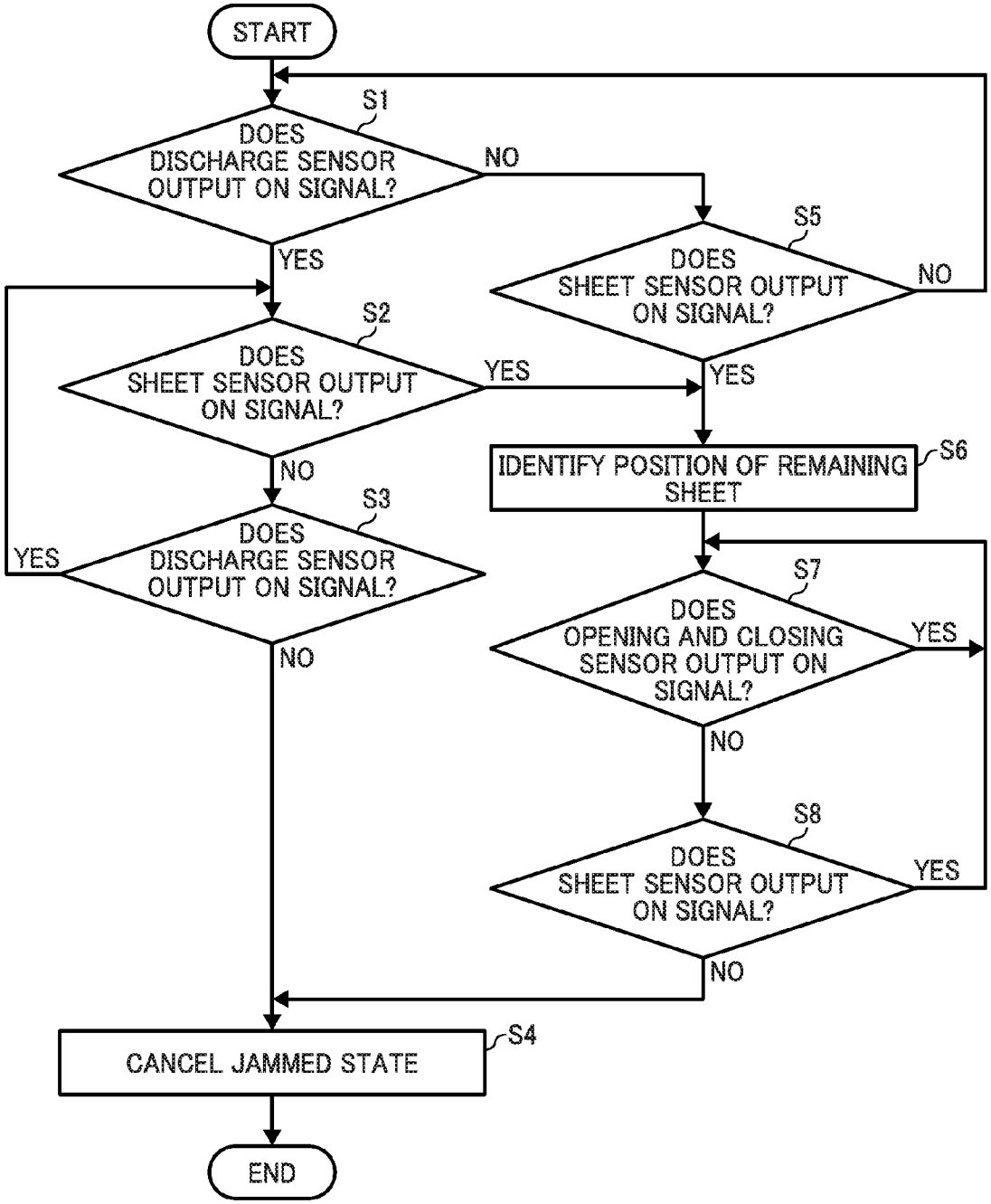
FIG. 6 is a flowchart illustrating steps in a control process according to an embodiment example.

FIG. 6 is a flowchart illustrating the steps in the above-described control process. When a jam detection process starts, the discharge sensor 21 detects the sheet presence or absence, i.e., the passage or non-passage of the sheet P through the discharge sensor 21 (step S1). If the discharge sensor 21 outputs an ON signal indicating the sheet presence, i.e., indicating that the sheet P has not passed through the discharge sensor 21 (YES at step S1), the controller 13 checks whether or not the sheet P is detected by the fixing exit sheet sensor 22 located upstream of the discharge sensor 21 in the sheet feeding direction (step S2). If the sheet P is not detected by the fixing exit sheet sensor 22, i.e., if the sheet absence is detected (NO at step S2), the controller 13 again checks whether or not the sheet P has passed through the discharge sensor 21 (step S3). If the discharge sensor 21 still outputs the ON signal indicating the sheet presence (YES at step S3), the process returns to step S2. The process loops between steps S2 and S3 until the discharge sensor 21 outputs an OFF signal. If the output of the discharge sensor 21 shifts to the OFF signal indicating the sheet absence at step S3 (NO at step S3), the controller 13 cancels the jammed state (step S4).

Meanwhile, if the discharge sensor 21 detects the sheet absence, i.e., if the sheet P has passed through the discharge sensor 21 at step S1 (NO at step S1), the controller 13 checks whether or not the sheet P is detected by the fixing exit sheet sensor 22 located upstream of the discharge sensor 21 in the sheet feeding direction (step S5). If the sheet P is not detected by the fixing exit sheet sensor 22 (NO at step S5), the process returns to step S1. If the sheet P is detected by the fixing exit sheet sensor 22, i.e., if the sheet presence is detected (YES at step S5), the controller 13 determines the position of the sheet P (step S6). That is, the controller 13 determines that the sheet P being discharged is not clamped by the sheet discharge roller pair 5 but is clamped by the fixing device 4 located upstream of the sheet discharge roller pair 5 in the sheet feeding direction. Similarly, if the sheet P is detected by the fixing exit sheet sensor 22 at step S2 (YES at step S2), the controller 13 determines the position of the sheet P (step S6).

After the determination of the position of the sheet P, the controller 13 checks the output of the opening and closing sensor 24 that detects the opening and closing of the cover 10, until the closed state of the cover 10 is detected (until the opening and closing sensor 24 outputs an OFF signal indicating the cover closed state in step S7). If the output of the opening and closing sensor 24 shifts from an ON signal indicating the cover open state to the OFF signal indicating the cover closed state (NO at step S7), the controller 13 checks again whether or not the sheet P is detected by the fixing exit sheet sensor 22 (step S8). If the sheet absence is detected at step S8 (NO step S8), the process proceeds to step S4 to cancel the jammed state. If the sheet presence is detected at step S8 (YES at step S8), the process returns to step S7 to repeat the checks of steps S7 and S8.

As described above, according to the present embodiment, with the instructions for sheet removal presented to the operator, the instructions for the jammed sheet handling operation are clarified, thereby assisting the operator by providing a simpler sheet handling operation. Further, when the jammed sheet P has passed through the fixing device 4, i.e., when the print job on the sheet P has been completed, the image forming apparatus 100 checks with the operator as to the need to print the same image as the image for the jammed sheet P on the next sheet P, thereby avoiding unnecessary printing.

Figure 7:
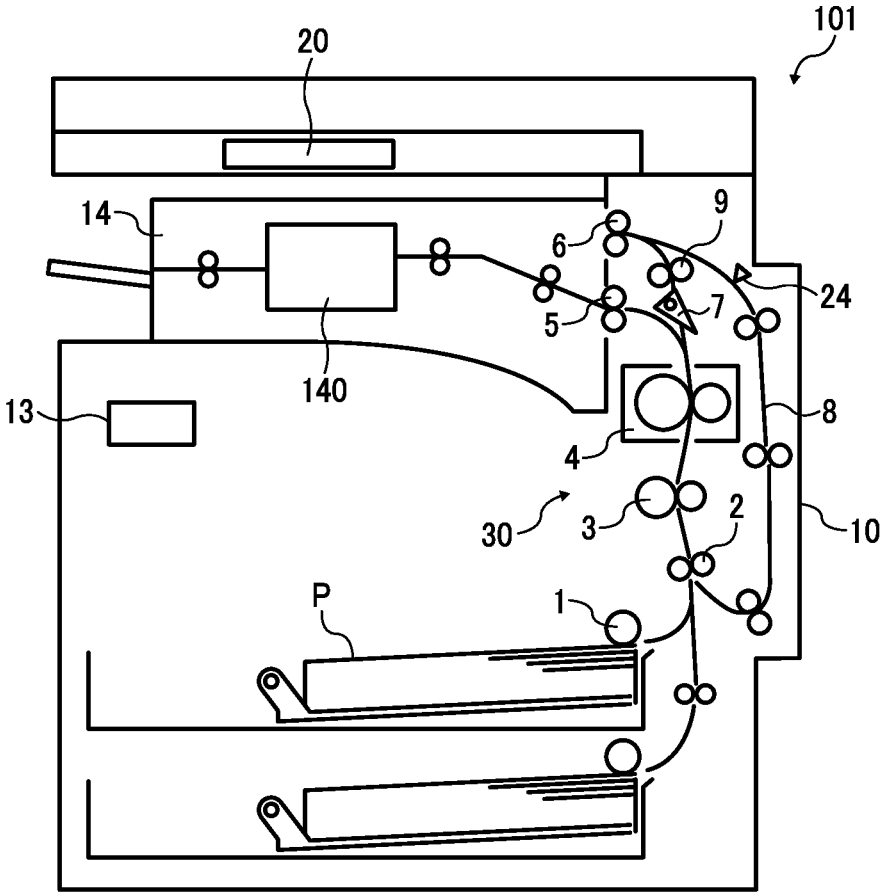
FIG. 7 is a diagram illustrating a configuration example of an image forming apparatus according to another embodiment example.

With reference to FIG. 7, description will now be given of a control process for a case in which a post-processing peripheral device is provided at a position downstream of the sheet discharge roller pair 5 in the sheet feeding direction. In this example, an image forming apparatus 101 according to another embodiment of the present invention includes a post-processing peripheral device 14 disposed downstream of the sheet discharge roller pair 5 in the sheet feeding direction to perform post-processing, such as binding, punching, and folding, on the sheet P discharged from the sheet discharge roller pair 5. Specifically, the post-processing peripheral device 14 includes a post-processing unit 140, which is a binding unit, a punching unit, a folding unit, or a combination of at least two of these units, for example. In this case, the jam of the sheet P is detected by a not-illustrated sensor included in the post-processing peripheral device 14. If the sheet P is detected by the discharge sensor 21 but not by the fixing exit sheet sensor 22 located upstream of the discharge sensor 21 in the sheet feeding direction, the controller 13 cancels the malfunction state due to the jam (i.e., jammed state) upon receipt of two types of information, i.e., the information output from the opening and closing sensor 24 indicating a shift from the open state to the closed state of the cover 10 and the OFF signal output from the discharge sensor 21 indicating the non-detection of the sheet P (i.e., sheet absence).

In the image forming apparatus 101 equipped with the post-processing peripheral device 14, when driving of the image forming apparatus 101 is stopped upon detection a jam, a time lag is generated between the detection of the jam and actual stop of driving of the image forming apparatus 101 owing to the time taken for communication, for example. Therefore, the jammed sheet P may be pulled out of the discharge sensor 21 before the driving of the image forming apparatus 101 is stopped. That is, the image forming apparatus 101 may be unintentionally brought into the normal state from the jammed state by the operator. In this case, a loop operation may occur in which the image forming apparatus 101 has a jam and returns to the normal state while the operator is unaware of the situation, depending on the jam occurrence condition. Therefore, an operation of opening and closing the cover 10 is added as a condition for returning the image forming apparatus 101 to the normal state to prevent the loop operation.

In an image forming apparatus including a reversing path with a reversing roller pair, as in the above-described embodiments including the reversing roller pair 6, it is possible to simplify the unjamming operation in not only the case of the sheet P jammed while being discharged to the exterior of the image forming apparatus but also the case of the sheet P jammed while being partially and temporarily discharged to the exterior of the image forming apparatus during, for example, the switchback reversing operation. Also in this case, with the instructions for sheet removal presented to the operator, the instructions for the jammed sheet handling operation are clarified to the operator, thereby assisting the operator by providing the simpler sheet handling operation.

Preferably, the pull force for pulling the sheet P out of the image forming apparatus 100 from the sheet discharge roller pair 5 clamping the sheet P is equal to or less than 22.2 N, which corresponds to the operating force specified in Section 508 of the U.S. Rehabilitation Act of 1973. That is, with the pull force set to be equal to or less than the above operating force, a wide range of people are capable of performing the unjamming operation from the side of the discharge section.

Further, in the image forming apparatus 100 including the fixing device 4 at a position upstream of the sheet discharge roller pair 5 in the sheet feeding direction, the fixing exit sheet sensor 22 is preferably located downstream of the fixing device 4 in the sheet feeding direction, as in the illustrated embodiment. More preferably, the fixing exit sheet sensor 22 is located downstream of the fixing nip of the fixing device 4 in the sheet feeding direction. With the sheet P allowed to be pulled out when having passed through the fixing device 4, damage to the image forming apparatus 100 caused by removing the jammed sheet P from the side of the discharge section (i.e., in-body discharge section) is reduced. That is, if the jammed sheet P is forcefully pulled out when still remaining in the fixing device 4 (i.e., the fixing nip), unfixed toner may be transferred to the interior of the fixing device 4 and then to the next sheet P, thereby staining the next sheet P and subsequent sheets P arriving the fixing device 4.

According to the sheet feeder control method, the sheet feeder, and the image forming apparatus according to embodiments of the present invention, if a jam is detected, and if a sheet remaining in the sheet feeder or the image forming apparatus is removable from outside the sheet feeder or the image forming apparatus, it is possible to check the removal of the remaining sheet and return the sheet feeder or the image forming apparatus to the normal state from the jammed state without opening and closing a cover of the sheet feeder or the image forming apparatus.

According to the present invention, if a sheet being discharged is stuck and detected by a discharge sensor but not by a sheet sensor located upstream of the discharge sensor in a sheer feeding direction, it is determined that most of the sheet has been discharged to the exterior of the sheet feeder or the image forming apparatus, and thus that it is possible to complete an unjamming operation by pulling the sheet out from outside the sheet feeder or the image forming apparatus without opening and closing a cover for allowing the unjamming operation. Accordingly, the procedure of the unjamming operation is simplified.

The above-described embodiments and effects thereof are illustrative only and do not limit the present invention. Thus, numerous additional modifications and variations are possible in light of the above teachings. For example, elements or features of different illustrative embodiments herein may be combined with or substituted for each other within the scope of this disclosure and the appended claims. Further, features of components of the embodiments, such as number, position, and shape, are not limited to those of the disclosed embodiments and thus may be set as preferred. Further, the above-described steps are not limited to the order disclosed herein. It is therefore to be understood that, within the scope of the appended claims, the disclosure of the present invention may be practiced otherwise than as specifically described herein.

What is claimed is:

1. A sheet feeder for an image forming apparatus including a sheet feed path exposable to an exterior of the sheet feeder, comprising:

a discharge member, located downstream of the sheet feed path in a sheet feeding direction, configured to discharge a sheet to the exterior of the sheet feeder;

a discharge sensor, located upstream of the discharge member in the sheet feed path, configured to detect the discharge of the sheet;

a fixing device, located upstream of the discharge member in the sheet feeding direction, configured to fix a toner image on the sheet;

a fixing exit sheet sensor, located downstream of the fixing device in the sheet feed path, configured to detect whether the sheet is clamped by the fixing device; and a controller, via a malfunction detector, configured to detect a sheet jam during the feeding and discharging of the sheet, wherein, if the sheet is detected by the discharge sensor but not by the fixing exit sheet sensor, the controller is configured to cancel a malfunction state due to the sheet jam when a signal output from the discharge sensor shifts from a signal indicating detection of the sheet to a signal indicating non-detection of the sheet.

2. The sheet feeder according to claim 1, wherein, if the sheet does not pass through the discharge sensor within a set time, the controller is configured to determine that the image forming apparatus is in a malfunction state.

3. The sheet feeder according to claim 1, wherein the malfunction state is a jammed state.

4. The sheet feeder according to claim 1, wherein the controller is configured to stop feeding the sheet in the malfunction state.

5. The sheet feeder according to claim 1, further comprising a reversing device configured to partially and temporarily discharge the sheet to the exterior of the sheet feeder and be reversely rotated to feed the sheet to a duplex feed path of the sheet feed path, with the sheet reversed; and a reversed sheet sensor configured to detect the sheet reversed by the reversing device, wherein, if the jammed sheet is detected by the reversed sheet sensor, the controller is configured to cancel the malfunction state due to the sheet jam when a signal output from the reversed sheet sensor shifts from a signal indicating detection of the sheet to a signal indicating non-detection of the sheet.

6. An image forming apparatus, comprising: a sheet feeder including:

a discharge member, located downstream of a sheet feed path in a sheet feeding direction, configured to discharge a sheet to an exterior of the sheet feeder;

a discharge sensor, located upstream of the discharge member in the sheet feed path, configured to detect the discharge of the sheet;

a fixing device, located upstream of the discharge member in the sheet feeding direction, configured to fix a toner image on the sheet;

a fixing exit sheet sensor, located downstream of the fixing device in the sheet feed path, configured to detect whether the sheet is clamped by the fixing device; and a controller, via a malfunction detector, configured to detect a sheet jam during the feeding and discharging of the sheet, wherein, if the sheet is detected by the discharge sensor but not by the fixing exit sheet sensor, the controller is configured to cancel a malfunction state due to the sheet jam when a signal output from the discharge sensor shifts from a signal indicating detection of the sheet to a signal indicating non-detection of the sheet.

7. The image forming apparatus according to claim 6, wherein, if the sheet does not pass through the discharge sensor within a set time, the controller is configured to determine that the image forming apparatus is in a malfunction state.

8. The image forming apparatus according to claim 6, wherein the malfunction state is a jammed state.

9. The image forming apparatus according to claim 6, wherein the controller is configured to stop feeding the sheet in the malfunction state.

10. The image forming apparatus according to claim 6, further comprising:

a sheet feed member to separate the sheet from other sheets.

11. The image forming apparatus according to claim 10, further comprising:

a reversing device configured to partially and temporarily discharge the sheet to the exterior of the sheet feeder and be reversely rotated to feed the sheet to a duplex feed path of the sheet feed path, with the sheet reversed; and a reversed sheet sensor configured to detect the sheet reversed by the reversing device, wherein, if the jammed sheet is detected by the reversed sheet sensor, the controller is configured to cancel the malfunction state due to the sheet jam when a signal output from the reversed sheet sensor shifts from a signal indicating detection of the sheet to a signal indicating non-detection of the sheet.

12. The image forming apparatus according to claim 11, further comprising:

a presentation device configured to present information for the operation of the image forming apparatus, wherein, if the jammed sheet is detected by the reversed sheet sensor, the controller is configured to determine that the sheet is stopped with a part thereof discharged from the reversing device to the exterior of the image forming apparatus, and configured to cause the presentation device to present a prompt to manually extract the sheet from the image forming apparatus.

13. The image forming apparatus according to claim 10, further comprising:

a presentation device configured to present information for the operation of the image forming apparatus, wherein, if the jammed sheet is detected by the discharge sensor, the controller is configured to determine that the sheet is stopped during the discharge thereof from the discharge member, and configured to cause the presentation device to present a prompt to manually extract the sheet from the image forming apparatus.

14. The image forming apparatus according to claim 10, wherein the fixing device is configured to fix toner image on the sheet at a fixing nip by applying heat and pressure to the toner image on the sheet.

* * * * *